US006142133A

United States Patent [19]

Anderson

[11] Patent Number: 6,142,133

[45] Date of Patent: Nov. 7, 2000

[54] ARCHERY BOW HAVING AN IMPROVED CAM ARRANGEMENT

[76] Inventor: Jeffrey R. Anderson, 143A Slocum Lake Rd., Wauconda, Ill. 60084

[21] Appl. No.: 09/507,439

[22] Filed: Feb. 19, 2000

[51] Int. Cl.[7] ..... F41B 5/10

[52] U.S. Cl. ..... 124/25.6; 124/24.1

[58] Field of Search ..... 124/24.1, 25, 25.6, 124/44.5, 900

[56] References Cited

U.S. PATENT DOCUMENTS

| | | | |
|---|---|---|---|
| 4,368,718 | 1/1983 | Simonds et al. | 124/25.6 |
| 4,515,142 | 5/1985 | Nurney | 124/25.6 |
| 4,829,974 | 5/1989 | Anderson . | |
| 4,958,617 | 9/1990 | Anderson | 124/24.1 |
| 5,119,797 | 6/1992 | Anderson | 124/25 |
| 5,263,465 | 11/1993 | Anderson | 124/24.1 |
| 5,921,227 | 7/1999 | Allshouse et al. | 124/25.6 |
| 5,960,778 | 10/1999 | Larson | 124/25.6 |
| 5,975,067 | 11/1999 | Strother | 124/25.6 |

*Primary Examiner*—John A. Ricci
*Attorney, Agent, or Firm*—Rolland R. Hackbart

[57] ABSTRACT

A compound archery bow has a top cam which is larger than a bottom cam so that the nock point travel between an at-rest position and a fully-drawn position follows substantially a straight line. The nock point on the bowstring positions an arrow substantially perpendicular to the bowstring in the at-rest position. Since the nock point follows a straight line collinear with the arrow center line and perpendicular to the bowstring in the at-rest position, the arrow is released without nonlinear torque or movement of the nock end as it is pushed forward by the bowstring.

17 Claims, 4 Drawing Sheets

100
120
180
190
121
122
104
191
131
90°
102
112
113
114
118
119
150
170
171
410
165
160
173
110
115
116
130
140
132
192
105
127
126
125

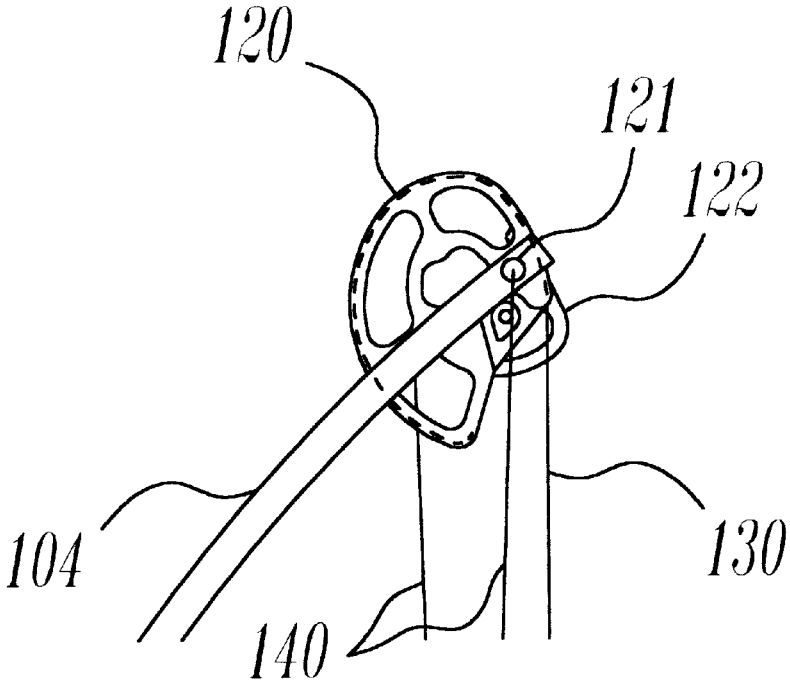
Fig. 2
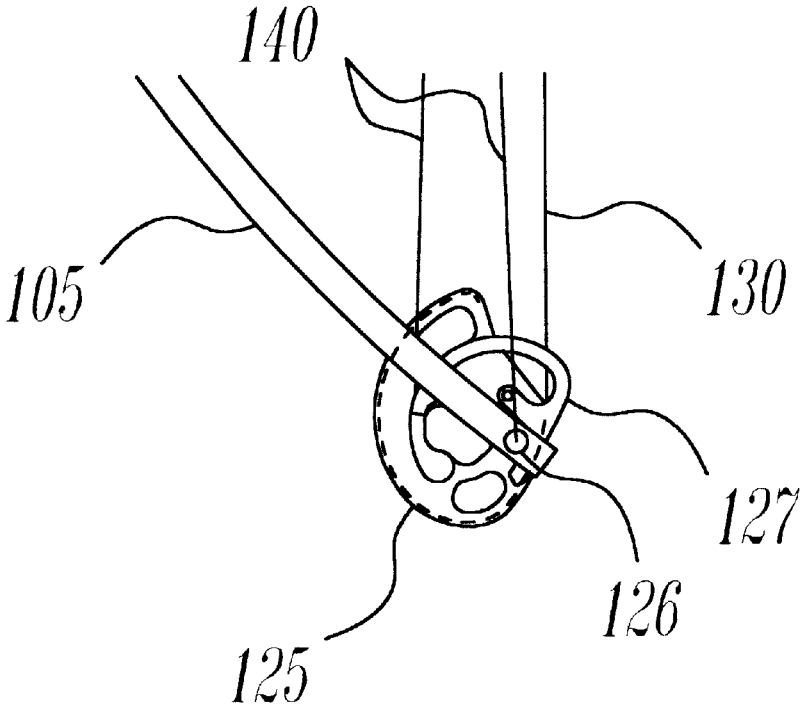

ARCHERY BOW HAVING AN IMPROVED CAM ARRANGEMENT

FIELD OF THE INVENTION

The present invention relates generally to the field of archery bows, and more particularly to an archery bow having an improved cam arrangement.

BACKGROUND OF THE INVENTION

A compound archery bow includes a riser coupled to top and bottom limbs and further includes top and bottom cams that each has an axle coupling it to the end of the respective limb. In order that an archer can hold the bow, a grip is located on the riser substantially at the midpoint between the axle of the top cam and the axle of the bottom cam. As a result, an arrow rest is located on the riser at a predetermined distance above the midpoint toward the top cam. A nock point on the bowstring is positioned to allow an arrow to be substantially perpendicular to the bowstring in the at-rest position. Since the top and bottom cams are substantially identical in size, the nock point travels in a nonlinear path (such as an arcing path) when the bowstring is pulled back and when the bowstring is released. Some of the energy of the drawn bowstring is expended in moving the arrow through the nonlinear path, and the arrow is nonlinearly moved, flexed and torqued. Accordingly, there is a need for an improved archery bow having a nock point that travels in a linear or straight line path, thereby avoiding nonlinear torque and movement of the nock end of an arrow as it is pushed forward by the bowstring.

BRIEF DESCRIPTION OF THE DRAWINGS

FIG. 2 is a left side view of the top and bottom cams in the compound archery bow in FIG. 1.

DETAILED DESCRIPTION OF THE PREFERRED EMBODIMENTS

An archery bow has a first or top cam which is larger than a second or bottom cam so that the nock point travel between an at-rest position and a fully-drawn position follows substantially a straight line. The nock point on the bowstring is positioned to allow an arrow to be substantially perpendicular to the bowstring in the at-rest position. Since the nock point follows a straight line collinear with the arrow center line and perpendicular to the bowstring in the at-rest position, the arrow is released without nonlinear torque or movement of the nock end as it is pushed forward by the bowstring.

Figure 1:
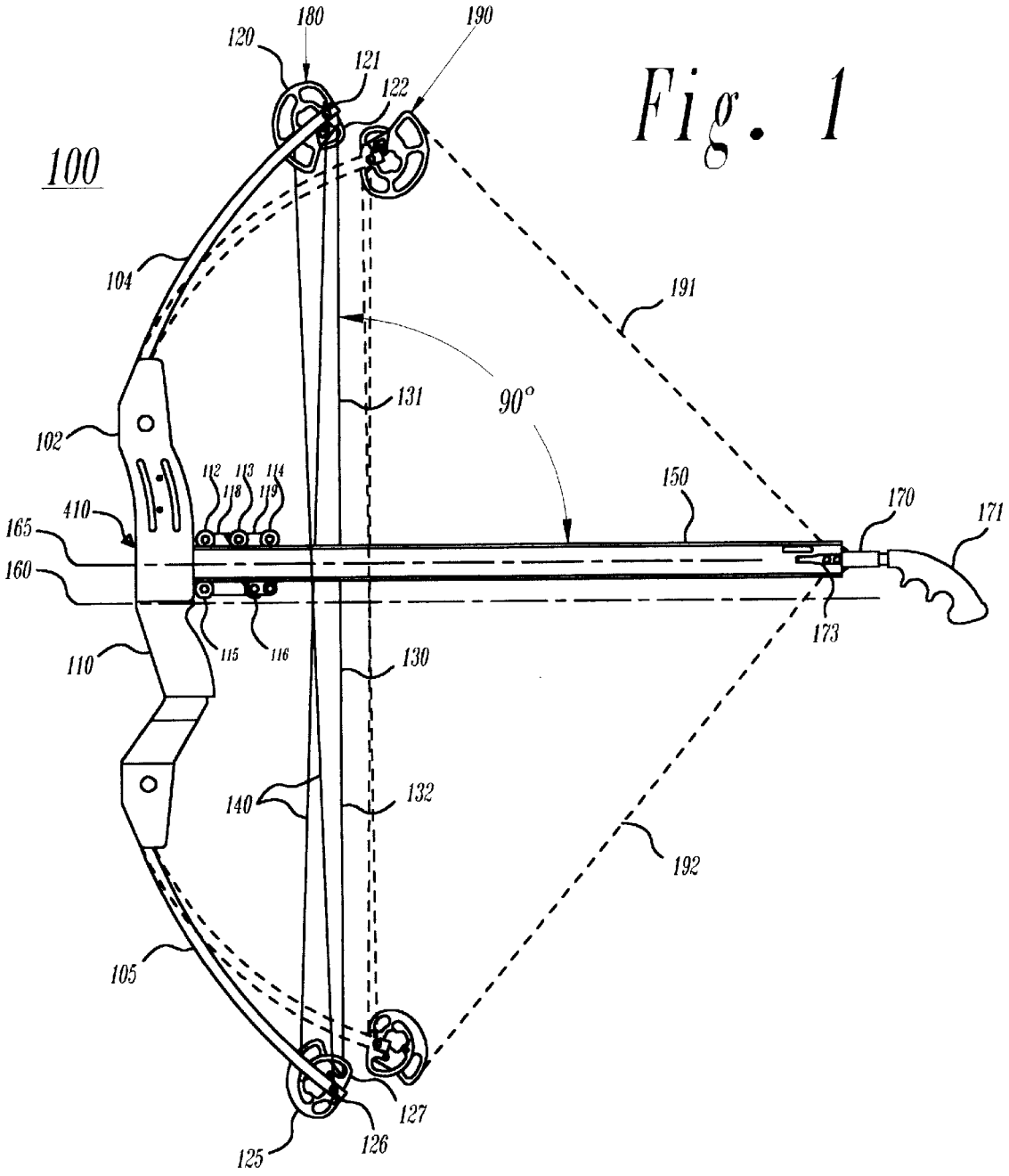
FIG. 1 is left-side view of a compound archery bow embodying the present invention.
Figure 4:
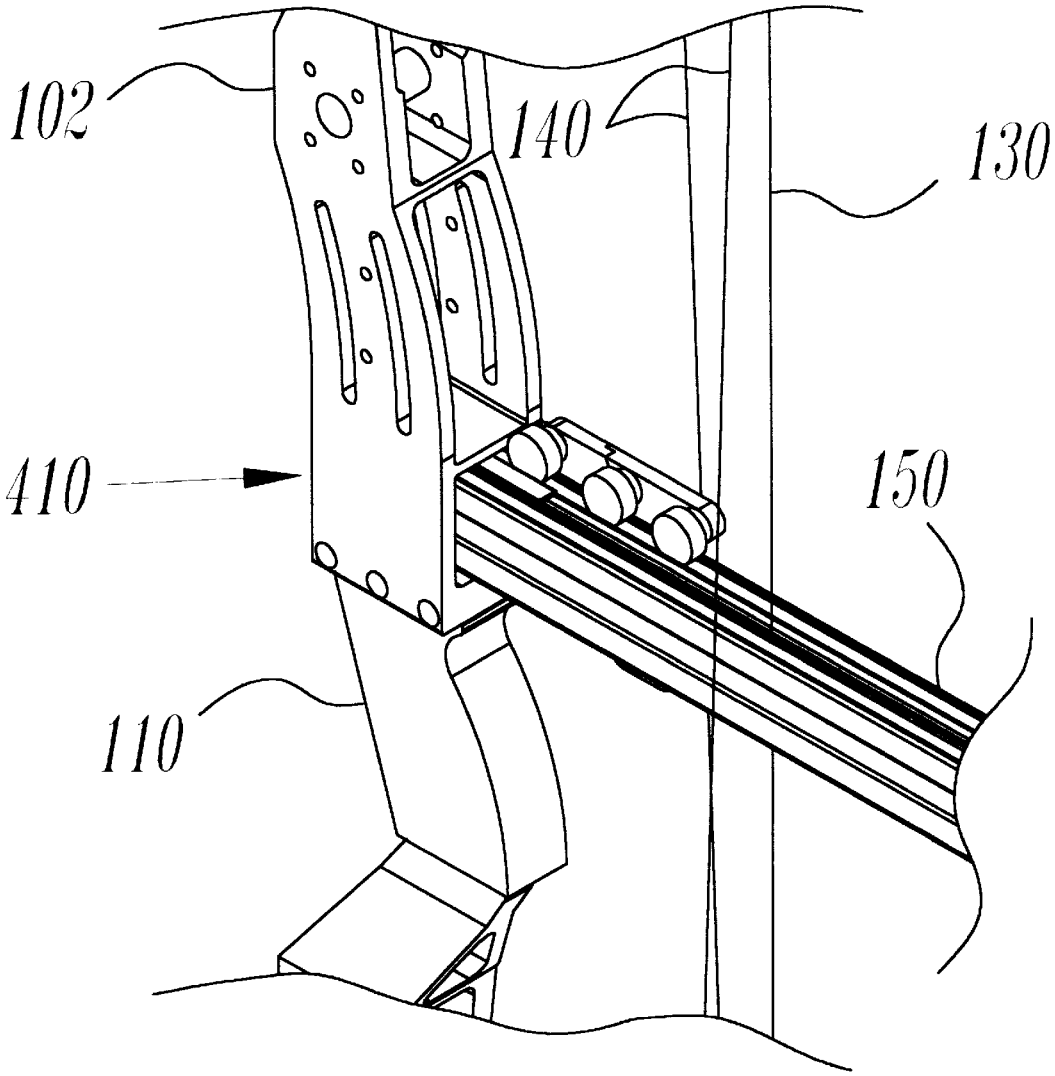
FIG. 4 is a cut away perspective view of the riser of the compound archery bow in FIG. 1.

Referring now to FIG. 1 there is illustrated a left-side view of a preferred embodiment of compound archery bow 100 embodying the present invention. Bow 100 includes a riser 102, first and second limbs 104 and 105, top cam 120, bottom cam 125, bowstring 130, harness 140, and arrow rest assembly 150. A grip 110 is attached to the center of the riser 102. The arrow rest assembly 150 is an elongated track having a muzzle end and a breach end. The muzzle end of the arrow rest assembly 150 extends through a keyhole 410 (see FIG. 4) in the riser 102 and is supported on rollers 112–116 mounted to front bracket 118 and pivot bracket 119.

The arrow rest assembly 150 is perpendicular to the bowstring 130 in the at-rest position 180. A dual-caliper string release 170 and string release grip 171 (both commercially available components) are attached to the breach end of arrow rest assembly 150.

Referring now to FIG. 2, there is illustrated a left side view of the top and bottom cams 120 and 125 in the compound archery bow 100 in FIG. 1. In the preferred embodiment, the cams 120 and 125 are so called "hatchet cams". Any suitable type of cam (e.g. circular, elliptical, etc.) may be used in practicing the present invention. The top cam 120 has an axle 121 about which it rotates when bow 100 is drawn, and the bottom cam 125 has an axle 126 about which it rotates when bow 100 is drawn. The bowstring 130 has a first end which is wound around top cam 120 and attached to a post thereof, where the dashed line indicates the center of the bowstring within the string groove of the cam. Similarly, the bowstring 130 has a second end which is wound around bottom cam 125 and attached to a post thereof, where the dashed line indicates the center of the bowstring within the string groove of the cam. The top cam 120 is attached to a module 122, and the bottom cam 125 is attached to a module 127. The modules 122 and 127 are attached to the harness 140, a first end of the harness 140 attached to a post of module 122 and a second end of the harness 140 attached to a post of module 127. The modules 122 and 127 are geometrically identical in size and shape, and are positioned in exactly the same relationship to their respective axles 121 and 126. When bow 100 is drawn, the modules 122 and 127 and harness 140 turn in synchronism with one another, each rotating the same number of degrees. The modules 122 and 127 in turn synchronously rotate the cams 120 and 125, respectively, when the bow 100 is drawn.

Referring back to FIG. 1, the compound archery bow 100 has a horizontal center line 160 or midpoint that is midway between the axle 121 of cam 120 and axle 126 of cam 125. In the embodiment in FIG. 1, the bow 100 has an axle to axle length of 40¼ inches. The arrow rest assembly 150 is positioned at 90 degrees with respect to bowstring 130. The grip 110 is located on the riser 102 close to the horizontal center line 160 so that bow 100 can be drawn more easily. As a result, the arrow rest assembly 150 is located on the riser 102 at a predetermined distance above the horizontal center line 160. That is the arrow rest assembly 150 is closer to top cam 120 than bottom cam 125. For example, the arrow center line 165 of the arrow rest assembly 150 is located 1⅝ inches above the horizontal center line 160. The arrow rest assembly 150, the arrow center line 165, a nocked arrow, and the horizontal center line 160 are all parallel to one another and perpendicular to the bowstring 130 in the at-rest position 180.

The center line of an arrow inserted into the muzzle end of the arrow rest assembly 150 is substantially collinear with the arrow center line 165 of the arrow rest assembly 150. The nock end of an arrow rests against the bowstring at a nock point (see, for example, nock point 320 in FIG. 3) on the bowstring 130. The nock point on the bowstring 130 is positioned to allow an arrow to be substantially perpendicular to the bowstring in the at-rest position 180. According to a novel feature of the present invention, the nock point on the bowstring 130 travels in a straight line collinear with arrow center line 165 when the bowstring 130 is pulled back and when the bowstring 130 is released. Since the nock point travels in a straight line, the energy of the drawn bowstring is focused substantially solely on imparting linear column load to the arrow. In the preferred embodiment and many other conventional dual-cam compound archery bows, the present invention can increase the arrow speed, enhance the ease of drawing the bow, result in quieter operation, and enhance accuracy. For example, in the preferred embodiment in FIG. 1, the AMO speed of the bow 100 has been increased from 225 to 234 feet per second by the present invention.

In FIG. 1, compound archery bow is shown in an at-rest position 180 and in a fully-drawn position 190 (limbs 104 and 105, harness 140 and bowstring 130 in dashed lines). In order that the nock point travel in a straight line collinear with the arrow center line 165 of the arrow rest assembly 150, it is necessary that bottom cam 125 dispense less bowstring than the top cam 120. For an axle to axle length of 40¼ inches and an offset of 1⅝ inches between the horizontal center line 160 and the arrow center line 165, the top cam 120 should dispense 6.9229 inches of bowstring and the bottom cam 125 should dispense 5.9621 inches of bowstring to maintain the nock point collinear with the arrow center line 165 and perpendicular to the bowstring 130 in the at-rest position 180. That is, the bottom cam 125 should dispense 0.9608 inches less bowstring than top cam 120. The length of the portion 131 of the bowstring 130 from the arrow center line 165 to the first point of contact with the string groove of the top cam 120 is 17.6641 inches in the at-rest position 180. The length of the portion 191 of the bowstring 130 from the arrow center line 165 to the first point of contact with the string groove of the top cam 120 is 24.587 inches in the fully-drawn position 190. The difference between the length of portion 131 and portion 191 is 6.9229 inches. Similarly, the length of the portion 132 of the bowstring 130 from the arrow center line 165 to the first point of contact with the string groove of the bottom cam 125 is 20.9041 inches in the at-rest position 180. The length of the portion 192 of the bowstring 130 from the arrow center line 165 to the first point of contact with the string groove of the bottom cam 125 is 26.8662 inches in the fully-drawn position 190. The difference between the length of portion 132 and portion 192 is 5.9621 inches.

Thus, according to the present invention, the bottom cam 125 should be scaled a predetermined amount smaller than the top cam 120 in order to dispense a smaller amount of bowstring when being drawn. The top and bottom cams are substantially identical in shape, but the bottom cam 125 is scaled a predetermined amount smaller than the top cam 120. In the example above, the bottom cam 125 is 86.1214% of the size of the top cam 120 in order to dispense 0.9608 inches less bowstring than top cam 120. The scaling percentage of 86.1214% is determined by dividing 5.9621 by 6.9229 and multiplying by 100. The reference point for scaling the bottom cam 125 with respect to the top cam 120 is the center of the axle 121 or pivot point of the top cam 120. According to a further feature of the present invention, the top and bottom cams 120 and 125 should have the same weight for symmetrical dynamics.

Figure 3:
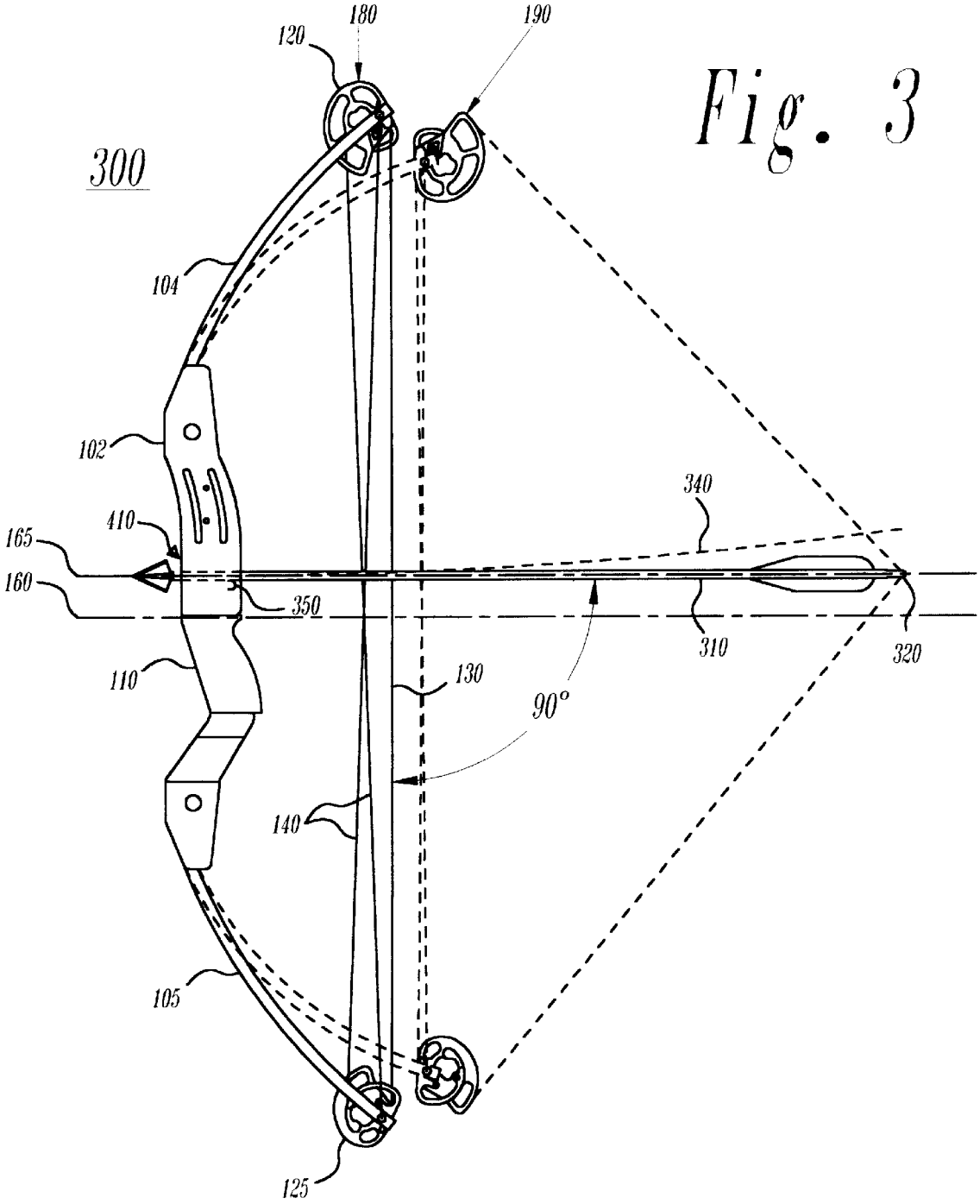
FIG. 3 is a left-side view of an alternate embodiment of a compound archery bow embodying the present invention.

Referring now to FIG. 3, there is illustrated a left-side view of an alternate embodiment of a compound archery bow 300 embodying the present invention. Elements in FIG. 3 that are identical to elements in FIG. 1 are labeled with the same reference number. Bow 300 includes a conventional arrow rest 350 rather than the arrow rest assembly 150 of bow 100 in FIG. 1. The arrow rest 350 is located inside the keyhole 410 (see FIG. 4) of the riser 102 in FIG. 1. Although shown inside the keyhole 410 of riser 102, a conventional riser with an offset arrow shelf for mounting the arrow rest 350 may also be used. Bow 300 is similar to bow 100 in FIG. 1, in that bow 300 has an axle to axle length of 40¼ inches and an offset of 1⅝ inches between the horizontal center line 160 and the arrow center line 165. A long arrow 310 is on the arrow rest 350 and attached at its nock end to the nock point 320 of the bowstring 130. The arrow center line 165 is perpendicular to the bowstring 130 in the at-rest position 180. Using the cams 120 and 125 scaled in accordance with the present invention, the nock point 320 travels in a straight line collinear with arrow center line 165 when the bowstring 130 is pulled back and when the bowstring 130 is released. Thus, the present invention can be advantageously utilized on any dual-cam compound archery bow with any conventional arrow rest. If the cams 120 and 125 are substantially identical in shape and size as in the prior art, the nock point 320 travels in a nonlinear line 340 (an arcing upward path) when the bowstring of a prior art bow is pulled back and when the bowstring of a prior art bow is released.

Compound archery bow 100 in FIG. 1 may also be constructed and operated substantially as shown and described in my U.S. Pat. Nos. 4,829,974 and 5,263,465, incorporated herein in their entirely by reference thereto. Bow 100 can shoot arrows of any suitable length, including, for example, the short arrow shown in FIG. 3 of my aforementioned U.S. Pat. No. 4,829,974, the short arrow shown in FIG. 3 of my aforementioned U.S. Pat. No. 5,263,465, the short arrow shown in FIG. 5 of my U.S. Pat. No. 5,119,797 incorporated herein in its entirely by reference thereto, and the short arrow shown and described in my U.S. Pat. No. 4,958,617 incorporated herein in its entirely by reference thereto.

In operating the compound archery bow 100 in FIG. 1, arrow rest assembly 150 is moved between a stored position (see FIG. 1 the aforementioned U.S. Pat. No. 5,263,465) and a proper operating position in FIG. 1. While in the stored position, an arrow of sufficiently short length, such as for example a six inch short arrow (see FIG. 3 of the aforementioned U.S. Pat. No. 5,263,465) may be stored within arrow rest assembly 150 to be ready for a shot. The arrow rest assembly 150 is pulled from the stored position and comes into contact with a stop so that it will not come out of contact with the rollers 113, 114 and 116 of the pivot bracket 119 of bow 100 in FIG. 1. The arrow rest assembly 150 is then pivoted up and automatically stops in the proper operating position shown in FIG. 1. The arrow rest assembly 150 may now be moved forward so that the breach end and string release 170 touch the bowstring 130. The bowstring 130 extends through a slot in the arrow rest assembly 150 and engages the calipers of the string release 170 when the arrow rest assembly 150 is moved forward so that the breach end and string release 170 touch the bowstring 130.

In order to load and shoot an arrow from the compound archery bow 100 in FIG. 1, the arrow rest assembly 150 is pushed forward until the string release 170 touches the bowstring 130. The trigger on string release 170 is pushed forward so that the dual calipers of the release 170 capture the bowstring 130. Next, the arrow rest assembly 150 is pointed upward and an arrow is inserted into the muzzle end thereof. Two polyurethane (or other suitable material) arrow guide strips (see strips 36 and 36 in FIG. 6 of the aforementioned U.S. Pat. No. 5,263,465) insert into the arrow rest assembly 150 from the muzzle end. The arrow guide strips guide an arrow that is inserted into the muzzle end of the arrow rest assembly 150. An arrow spring 173 on the side of the arrow rest assembly 150 at the breach end is lifted to allow the nock end of the arrow to come into contact with the bowstring 130. The arrow spring 173 applies a force to the arrow in the arrow rest assembly 150 so that the arrow does not inadvertently fall out if bow 100 is point downward. Then, in order to shoot, the bow 100 is drawn in the normal manner pulling on the string release grip 171. The arrow rest assembly 150 reciprocates back on quiet rollers to the fully-drawn position 190 in FIG. 1 and is held by hand at full draw. Next, the trigger on string release 170 is pulled back to release the arrow. During the release, the hand holding the string release grip 171 is firmly anchored against the cheek. The bow 100 is held steady by one hand on the riser 102 and the other hand on the string release grip 171. After releasing the bowstring and arrow, the arrow rest assembly 150 is pushed forward so that the dual calipers of the release 170 capture the bowstring 130 in preparation for another shot.

Thus, a compound archery bow includes first and second cams of different sizes so that the nock point on the bowstring travels in a straight line collinear with arrow center line between an at-rest position of the bowstring and a fully-drawn position of the bowstring. As a result, an arrow is released without perturbations in the nock point travel, thereby eliminating nonlinear torque and movement of the nock end of the arrow as it is pushed forward by the bowstring. The novel cam arrangement of the present invention can be advantageously used on any conventional dual-cam compound archery bow to provide increased arrow speed, enhanced ease of drawing the bow, quieter operation, and enhanced accuracy.

While particular embodiments of my invention have been shown and described, modifications may be made. It is therefore intended in the appended claims to cover all such changes and modifications which fall within the true spirit and scope of my invention.

What is claimed is:

1. An archery bow, comprising:

first and second limbs, each having first and second ends;

a riser to receive the first end of the first and second limbs;

a first cam with an axle to couple to the second end of the first limb, the first cam having a first predetermined size;

a second cam with an axle to couple to the second end of the second limb, the second cam having a second predetermined size, and the second predetermined size scaled a predetermined amount smaller than the first predetermined size;

an arrow rest on the riser at a predetermined distance from the midpoint of the distance between the axle of the first cam and the axle of the second cam, the arrow rest closer to the first cam than the second cam; and a bowstring to extend between the first and second cams, the bowstring having a nock point to allow an arrow to be perpendicular to the bowstring at rest; and the second cam rotating substantially in synchronism with the first cam to dispense less bowstring than the first cam so that the nock point travels in a substantially linear path when the bowstring is pulled back and when the bowstring is released.

2. The archery bow according to claim 1, wherein the first and second cams are hatchet cams.

3. The archery bow according to claim 1, wherein the arrow rest is comprised of an elongated track attached at a muzzle end to the riser and engaged at a breach end to a string release, the elongated track having a slot to receive the bowstring, and the elongated track to receive an arrow at the muzzle end.

4. The archery bow according to claim 3, wherein the string release is attached to the breach end of the elongated track.

5. The archery bow according to claim 3, wherein the string release is attached to the bowstring.

6. The archery bow according to claim 1, wherein the first cam and the second cam are constructed to have substantially the same weight.

7. A archery bow, comprising:

first and second limbs, each having first and second ends;

a riser to receive the first end of the first and second limbs;

a first cam with an axle to couple to the second end of the first limb, the first cam having a first predetermined size;

a first module attached to the first cam;

a second cam with an axle to couple to the second end of the second limb, the second cam having a second predetermined size, and the second predetermined size scaled a predetermined amount smaller than the first predetermined size;

a second module attached to the second cam, the second module substantially the same size as the first module;

an arrow rest on the riser at a predetermined distance from the midpoint of the distance between the axle of the first cam and the axle of the second cam, the arrow rest closer to the first cam than the second cam;

a harness to extend between the first and second modules, the first and second modules to rotate the first and second cams substantially in synchronism; and a bowstring to extend between the first and second cams, the bowstring having a nock point to allow an arrow to be perpendicular to the bowstring at rest; and the second cam rotating substantially in synchronism with the first cam to dispense less bowstring than the first cam so that the nock point travels in a substantially linear path when the bowstring is pulled back and when the bowstring is released.

8. The archery bow according to claim 7, wherein the first and second cams are hatchet cams.

9. The archery bow according to claim 7, wherein the arrow rest is comprised of an elongated track attached at a muzzle end to the riser and engaged at a breach end to a string release, the elongated track having a slot to receive the bowstring, and the elongated track to receive an arrow at the muzzle end.

10. The archery bow according to claim 9, wherein the string release is attached to the breach end of the elongated track.

11. The archery bow according to claim 9, wherein the string release is attached to the bowstring.

12. The archery bow according to claim 7, wherein the first cam and the second cam are constructed to have substantially the same weight.

13. An archery bow, comprising:

first and second limbs, each having first and second ends;

a riser to receive the first end of the first and second limbs, the riser further having a keyhole;

a first cam with an axle to couple to the second end of the first limb, the first cam having a first predetermined size;

a second cam with an axle to couple to the second end of the second limb, the second cam having a second predetermined size, and the second predetermined size scaled a predetermined amount smaller than the first predetermined size;

a string release;

an arrow rest assembly comprised of an elongated track extending through the keyhole of the riser and attached at a muzzle end to the riser and engaged at a breach end to the string release, the arrow rest assembly at a predetermined distance from the midpoint of the distance between the axle of the first cam and the axle of the second cam, the arrow rest assembly closer to the first cam than the second cam, the arrow rest assembly having an arrow center line; and a bowstring to extend between the first and second cams, the bowstring having a nock point to allow an arrow to be perpendicular to the bowstring at rest, the arrow center line perpendicular to the bowstring at rest, and the second cam rotating substantially in synchronism with the first cam to dispense less bowstring than the first cam so that the nock point travels in a substantially collinear path with the arrow center line when the bowstring is pulled back and when the bowstring is released.

14. The archery bow according to claim 13, wherein the first and second cams are hatchet cams.

15. The archery bow according to claim 13, wherein the string release is attached to the breach end of the elongated track.

16. The archery bow according to claim 13, wherein the string release is attached to the bowstring.

17. The archery bow according to claim 13, wherein the first cam and the second cam are constructed to have substantially the same weight.

* * * * *